US012616303B2

(12) United States Patent
He

(10) Patent No.: US 12,616,303 B2
(45) Date of Patent: May 5, 2026

(54) MULTIDIMENSIONAL ROCKING CHAIR

(71) Applicant: Guangzhou Mastela Commodity Co., LTD, Guangzhou (CN)

(72) Inventor: Yaming He, Maoming (CN)

( * ) Notice: Subject to any disclaimer, the term of this patent is extended or adjusted under 35 U.S.C. 154(b) by 0 days.

(21) Appl. No.: 19/330,922

(22) Filed: Sep. 17, 2025

(65) Prior Publication Data

US 2026/0007235 A1 Jan. 8, 2026

(51) Int. Cl.
*A47C 3/025* (2006.01)
*A47C 1/024* (2006.01)

(52) U.S. Cl.
CPC ..... *A47C 3/0251* (2018.08); *A47C 1/024* (2013.01)

(58) Field of Classification Search
CPC ..... A47C 3/0251; A47C 1/024
USPC ..... 297/260.2
See application file for complete search history.

(56) References Cited

U.S. PATENT DOCUMENTS

| | | | | |
|---|---|---|---|---|
| 7,722,118 | B2 * | 5/2010 | Bapst | A47D 9/057 297/260.2 |
| 8,239,984 | B2 | 8/2012 | Hopke | |
| 8,827,366 | B2 | 9/2014 | Hopke | |
| 9,433,303 | B2 | 9/2016 | Zhong | |
| 9,743,779 | B2 | 8/2017 | Zhao et al. | |
| 9,968,204 | B2 * | 5/2018 | Mountz | A47D 1/10 |
| 10,045,635 | B2 * | 8/2018 | Mountz | |
| 2015/0245719 | A1 * | 9/2015 | Zhong | A47D 9/057 297/260.2 |
| 2016/0066708 | A1 * | 3/2016 | Sclare | A47D 9/057 297/260.2 |

* cited by examiner

*Primary Examiner* — Anthony D Barfield

(57) ABSTRACT

A multidimensional rocking chair is provided, belonging to the technical field of rocking chairs, including a reclining seat and a base. The reclining seat includes a seat cushion part and a backrest part. The base has provided therein a driving machine. The driving machine has an output end connected to the reclining seat to drive movement of the reclining seat. The driving machine includes a horizontal sliding module and a vertical lifting module. The horizontal sliding module is configured to drive the reclining seat to move horizontally, and the vertical lifting module is configured to drive the reclining seat to move vertically.

17 Claims, 11 Drawing Sheets

MULTIDIMENSIONAL ROCKING CHAIR

TECHNICAL FIELD

The present disclosure belongs to the technical field of rocking chairs, more particularly to a multidimensional rocking chair.

BACKGROUND

Babies often need gentle shaking during their growth process to gain a sense of safety and comfort, which is beneficial for soothing or falling asleep. To alleviate the burden on caregivers, various electric rocking chairs or soothing chairs have emerged in the market. Most existing products employ motors or mechanical transmission devices to drive a seat to swing, simulating the effect of manual shaking.

In existing technologies, common baby rocking chairs can be generally divided into two types. One is to swing the seat back and forth through a bracket structure. The other is to drive the seat to swing left and right through base transmission. Although this shaking method of single degree of freedom can achieve a certain degree of soothing effect, it is still difficult to simulate the common compound movements in parents embrace, such as the combination of up and down gentle shaking and horizontal swing, resulting in limited experience for babies.

In addition, in terms of backrest adjustment, existing baby rocking chairs often employ simple rotating shaft and slot structures to achieve angle adjustment. This type of structure generally has problems such as inconvenient adjustment, few angle positions, and unreliable positioning. When a baby is moving on the seat, the angle of the backrest is easy to change, which poses a safety hazard.

Further, in terms of installation and cleaning, most existing baby rocking chairs adopt a fixed installation, and the connection between the seat and a base does not feature a quick-release function. This not only makes cleaning and maintenance inconvenient, but also presents a bulky device when in transport or storage.

Still further, most existing rocking chairs have a fixed orientation and lack easy seat rotation function. Parents often need to frequently move the entire device when feeding or taking care of a baby, which complicates operation and negatively impacts the user experience.

Therefore, the existing baby rocking chairs have shortcomings in terms of movement dimension, backrest adjustment, safety locking, seat quick-release, rotation flexibility and so on, and there is an urgent need to improve them.

SUMMARY

It is an object of the present disclosure to provide a multidimensional rocking chair against the shortcomings of the existing technologies, which is to overcome the problems of the existing technologies such as single mode of movement, inconvenient backrest adjustment, difficulty in disassembling and assembling a seat, and inflexible rotation. In order to achieve the above object, the present disclosure employs the following technical solution.

A multidimensional rocking chair includes:

- a reclining seat including a seat cushion part and a backrest part; and
- a base having provided therein a driving machine, the driving machine having an output end connected to the reclining seat to drive movement of the reclining seat.

Herein, the driving machine includes a horizontal sliding module and a vertical lifting module. The horizontal sliding module is configured to drive the reclining seat to move horizontally, and the vertical lifting module is configured to drive the reclining seat to move vertically.

Further, the seat cushion part and the backrest part have a hinged connection therebetween, and an included angle between the backrest part and the seat cushion part is adjustable.

Further, a plurality of locating holes are arranged at the hinged connection between the seat cushion part and the backrest part.

The backrest part is formed with a sliding slot; the sliding slot has an insert pin slidably mounted therein; and when the insert pin falls into any one locating hole, the included angle between the backrest part and the seat cushion part is limited at a corresponding position; and Herein, the sliding slot has provided therein a first elastic element; and the first elastic element is configured to apply onto the insert pin an elastic force toward the direction of the locating hole.

Further, the hinged connection between the backrest part and the seat cushion part is located at two sides of the backrest part; and a pull rope is provided and connected between the insert pins at the two sides.

When the pull rope is pulled, the pull rope causes the insert pin to squeeze against the spring and disengage from the locating hole.

Further, a gap is provided between the backrest part and the seat cushion part; and the pull rope can pass through the gap.

Further, the multidimensional rocking chair includes a bracket. The bracket is configured to connect the seat cushion part and the output end of the driving machine. The seat cushion part has an outer side provided with a limit part. The seat cushion part is snap-fitted with the bracket by means of the limit part; and the seat cushion part is inclined toward the backrest part.

Further, the multidimensional rocking chair includes a quick-release base. The reclining seat is detachably connected to the output end of the driving machine by means of the quick-release base.

Further, the output end of the driving machine is formed with an insert slot; and the insert slot has provided therein a quick-release spring and a quick-release tab.

The quick-release base can be sleeved around the output end. The quick-release base is formed with a through slot; and the through slot corresponds to the insert slot in position.

Herein, the quick-release tab extends into the through slot under the function of the spring, thereby to fix the quick-release base with the output end.

The through slot has provided therein a quick-release button. When the quick-release button is pressed to squeeze against the quick-release tab so that the quick-release tab exits the through slot, the quick-release base can be detached.

Further, the quick-release tab has an end head provided with a guide slope; and the guide slope is inclined toward the direction of compressing the quick-release spring.

When the quick-release base is sleeved from top down, a bottom end of the quick-release base abuts against the guide slope, whereby the quick-release tab squeezes against the quick-release spring and returns back. When the through slot is aligned to the insert slot, the quick-release tab inside the insert slot enters inside the through slot under the driving of the quick-release spring, thereby to fix the quick-release base with the output end.

Further, the base includes a bottom cover and an upper cover. The bottom cover and the upper cover have a cavity provided therebetween.

The cavity has provided therein a horizontal slide rail; and the driving machine is capable of sliding along the horizontal slide rail by slidable mounting on the horizontal slide rail.

The bottom cover has a bottom end formed with a limit sliding slot; and the limit sliding slot is not parallel to the horizontal slide rail.

The horizontal sliding module includes a horizontal motor and a horizontal cam. The horizontal cam is horizontally placed; the horizontal cam has a surface provided with a horizontal eccentric circular protrusion; and the eccentric circular protrusion is located inside the limit sliding slot; and Herein, when the horizontal motor drives the horizontal cam to rotate by means of a first transmission component, the horizontal eccentric circular protrusion is reciprocally sliding inside the limit sliding slot, whereby enabling the driving machine to reciprocally slide along the horizontal slide rail.

Further, the driving machine is provided with an upper slide-wheel set and a lower slide-wheel set. The upper slide-wheel set and the lower slide-wheel set are located at upper and lower sides of the horizontal slide rail respectively.

Further, the vertical lifting module includes:

a vertical cam driven by a vertical motor, the vertical cam being arranged vertically and having a surface provided with a vertical circular protrusion; and a vertical slide block slidably mounted inside the driving machine, the vertical slide block being capable of sliding vertically relative to the driving machine, the vertical slide block having a surface formed with a horizontal slot, and the vertical circular protrusion being slidably fit into the horizontal slot.

Herein, when the vertical motor drives the vertical cam to rotate by means of a second transmission component, the vertical circular protrusion is reciprocally sliding inside the horizontal slot, whereby enabling the vertical slide block to perform a vertical reciprocating motion.

Further, the output end of the driving machine is integrated with or connected to or abuts against the vertical slide block.

Further, a buffer spring is provided below the output end of the driving machine.

Further, the multidimensional rocking chair includes a rotating base. The rotating base is located between the base and the reclining seat. The rotating base is configured to adjust a horizontal angle between the base and the reclining seat.

Further, the rotating base includes:

a rotary plate connected to the output end of the driving machine; and a rotating shell formed with a circular groove, the rotary plate being located inside the circular groove, wherein the rotating shell and the rotary plate can have a relative rotation therebetween.

Herein, the rotating shell is fixedly connected to the reclining seat. The reclining seat is configured to adjust the horizontal angle between the reclining seat and the base by means of the fit between the rotating shell and the rotary plate.

Further, the rotary plate has a surface formed with a plurality of limit grooves.

The rotating shell has provided therein a switching tab and a switching spring. The switching spring is configured to drive the switching tab to fall into the limit groove of the rotary plate, whereby to limit the relative rotation between the rotary plate and the rotating shell.

The rotating shell has slidably mounted therein a switching button. The switching button is capable of pushing the switching tab to overcome the spring's force and disengage from the limit groove.

With the technical solution of the present disclosure, the present disclosure can achieve various technical effects. First, the combination of the horizontal sliding module and the vertical lifting module allows the rocking chair to perform compound movements in both horizontal and vertical directions, closer to the natural soothing action in parents' embrace, thereby effectively improving the comfort and sleep efficiency of babies. Second, the backrest adjustment structure achieves reliable adjustment of multiple angles and quick locking through the cooperation of the insert pin, the locating holes and the elastic element. Combined with the linkage of the pull rope, it significantly improves the convenience and safety of operation. In addition, the present disclosure provides a quick-release base between the driving machine and the reclining seat, which enables quick disassembly and assembly of the seat by means of the cooperation of a quick-release tab and a quick-release spring, facilitating daily cleaning, maintenance and transport. Meanwhile, the rotating base is arranged to combine with a switching tab, a switching spring and a limit groove, which enables the reclining seat to be adjusted in horizontal angle and securely fixed at a specific position, making it convenient for caregivers to use in different directions.

Therefore, the present disclosure not only solves the problems of the existing baby rocking chairs such as single dimension of movement, inconvenient backrest adjustment, difficulty in disassembling and assembling a seat and inflexible rotation, but also achieves comprehensive improvement in soothing effect, operational convenience and safety performance.

Other features and advantages of the present disclosure will be illustrated in the specification hereinafter and partially will become more apparent from a careful reading of the specification or become understandable by implementing the present disclosure. The purpose and other advantages of the present disclosure can be realized and obtained through the structure specified in the specification and accompany drawings.

BRIEF DESCRIPTION OF THE DRAWINGS

The present disclosure is described below in detail in conjunction with the drawings so that the above advantages of the present disclosure are clearer.

Figure 1:
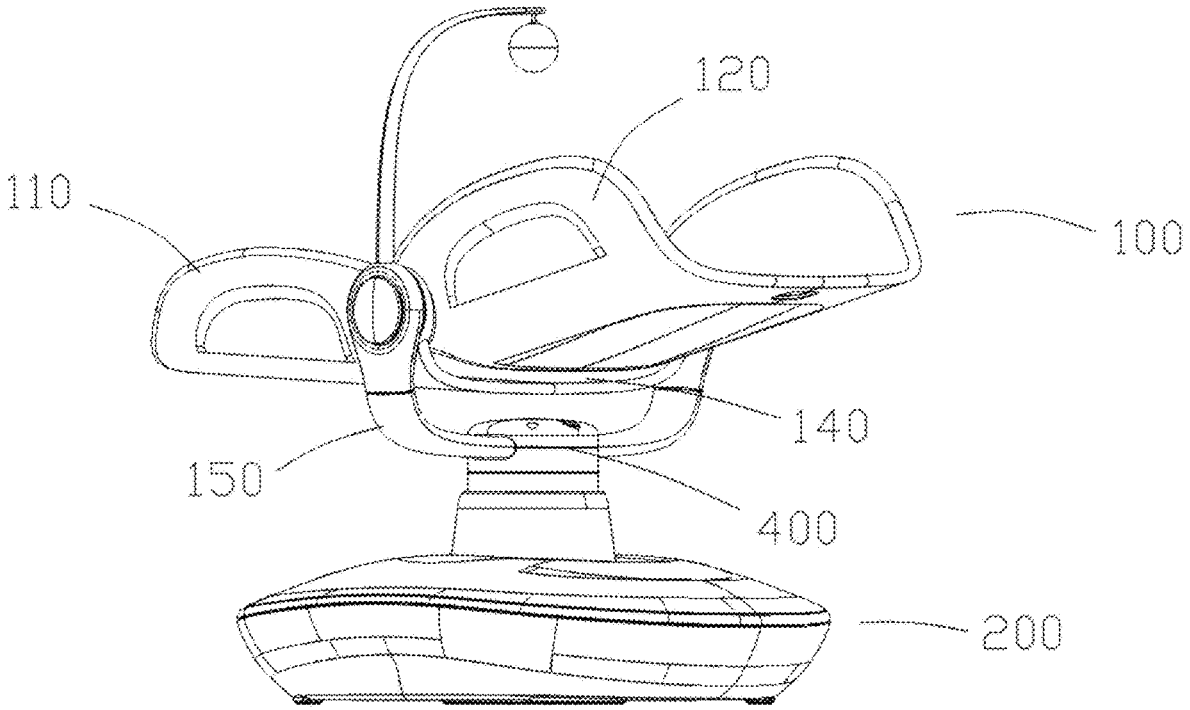
FIG. 1 is a diagram of a multidimensional rocking chair of the present disclosure.
Figure 2:
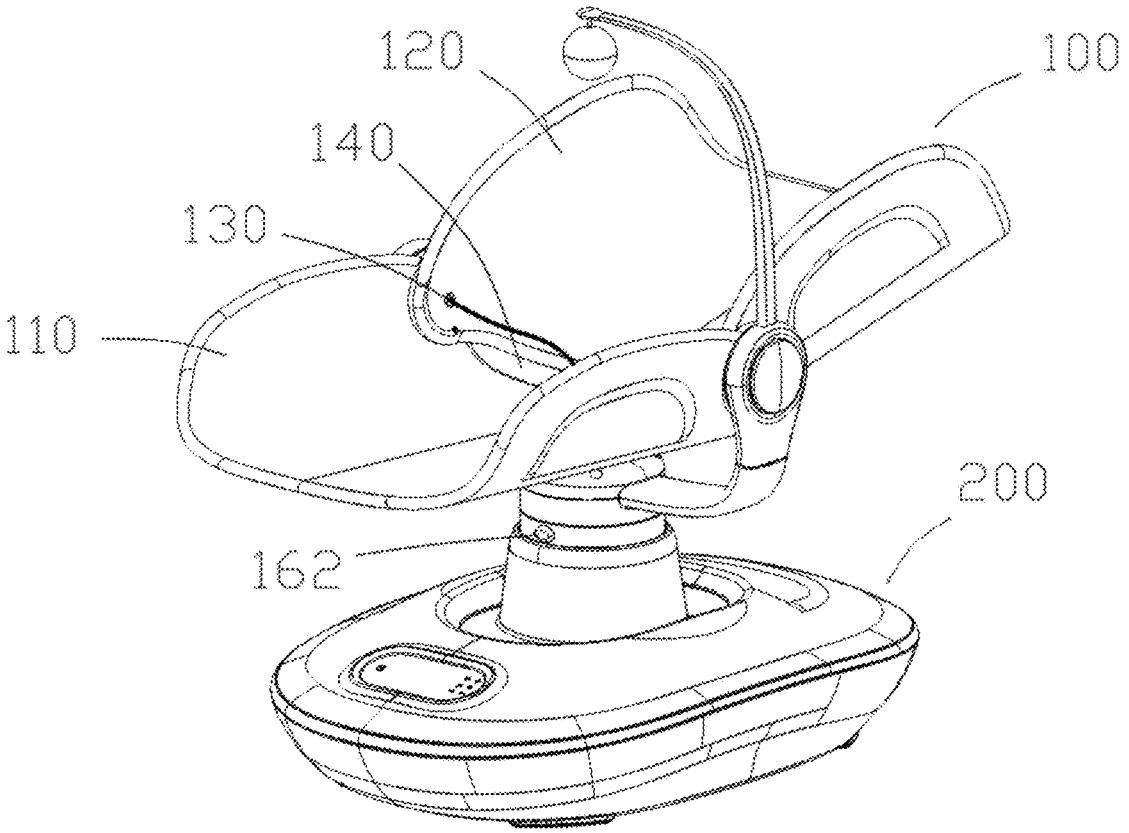
FIG. 2 is a structure diagram of a multidimensional rocking chair of the present disclosure.
Figure 3:
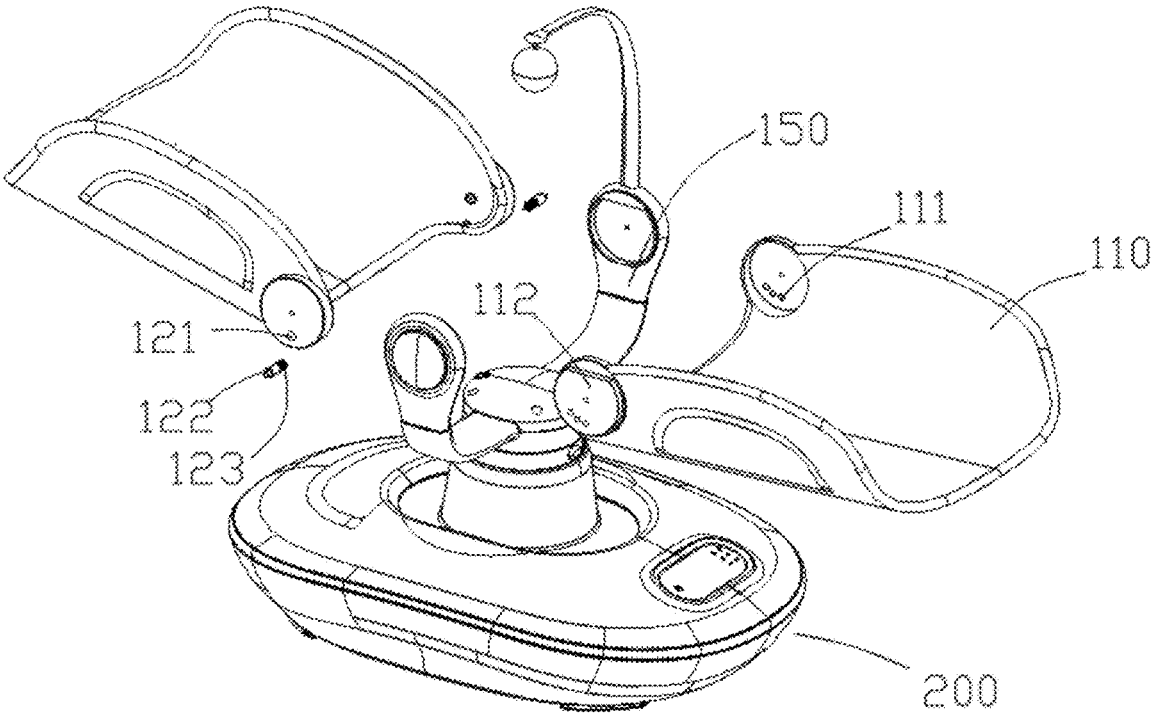
FIG. 3 is an exploded view of a seat of a multidimensional rocking chair of the present disclosure.
Figure 4:
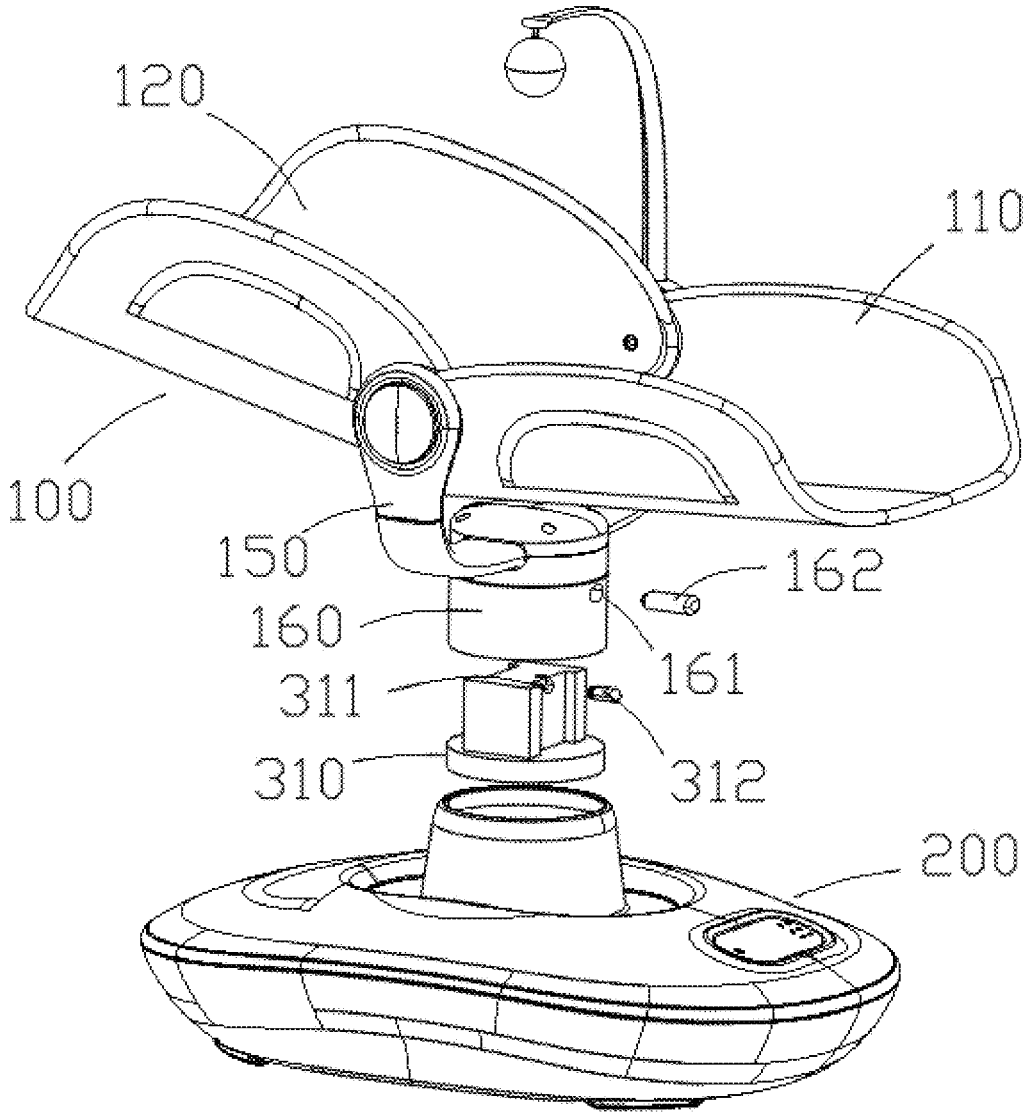
FIG. 4 is a local exploded view of a multidimensional rocking chair of the present disclosure.
Figure 5:
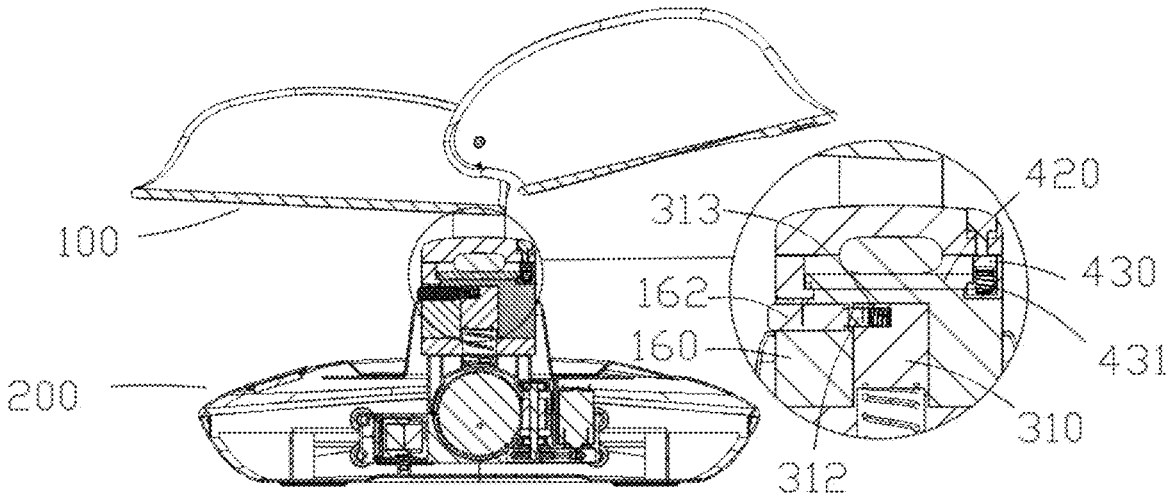
FIG. 5 is a half-sectional view of a multidimensional rocking chair of the present disclosure.
Figure 6:
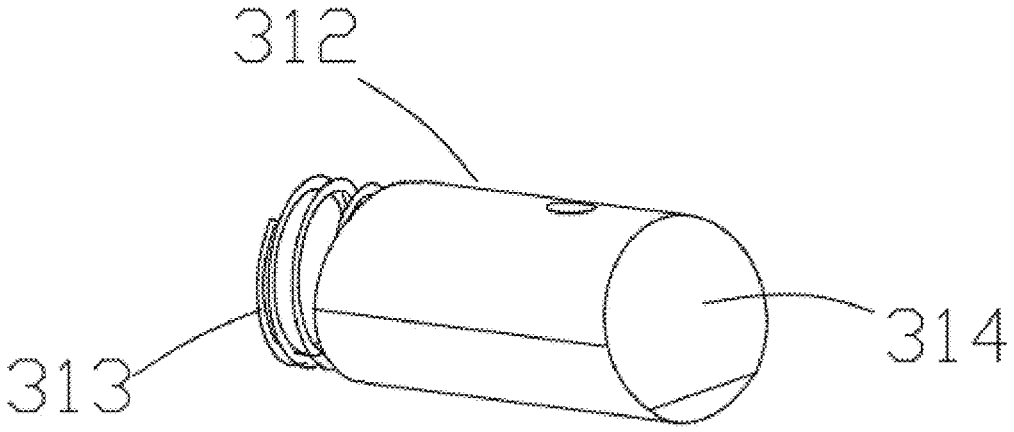
FIG. 6 is a diagram of a quick-release tab of a multidimensional rocking chair of the present disclosure.
Figure 7:
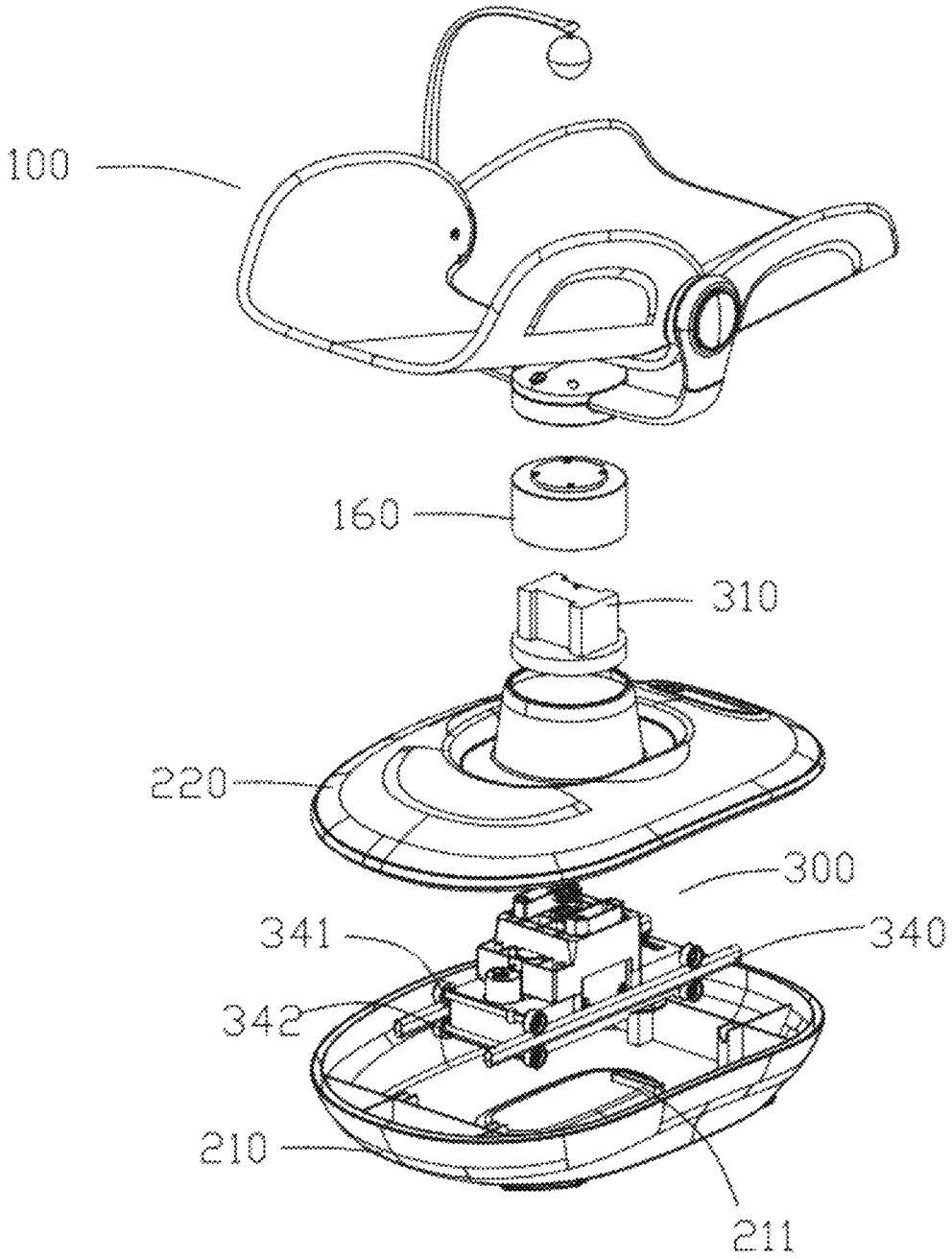
FIG. 7 is an exploded view of a base of a multidimensional rocking chair of the present disclosure.
Figure 8:
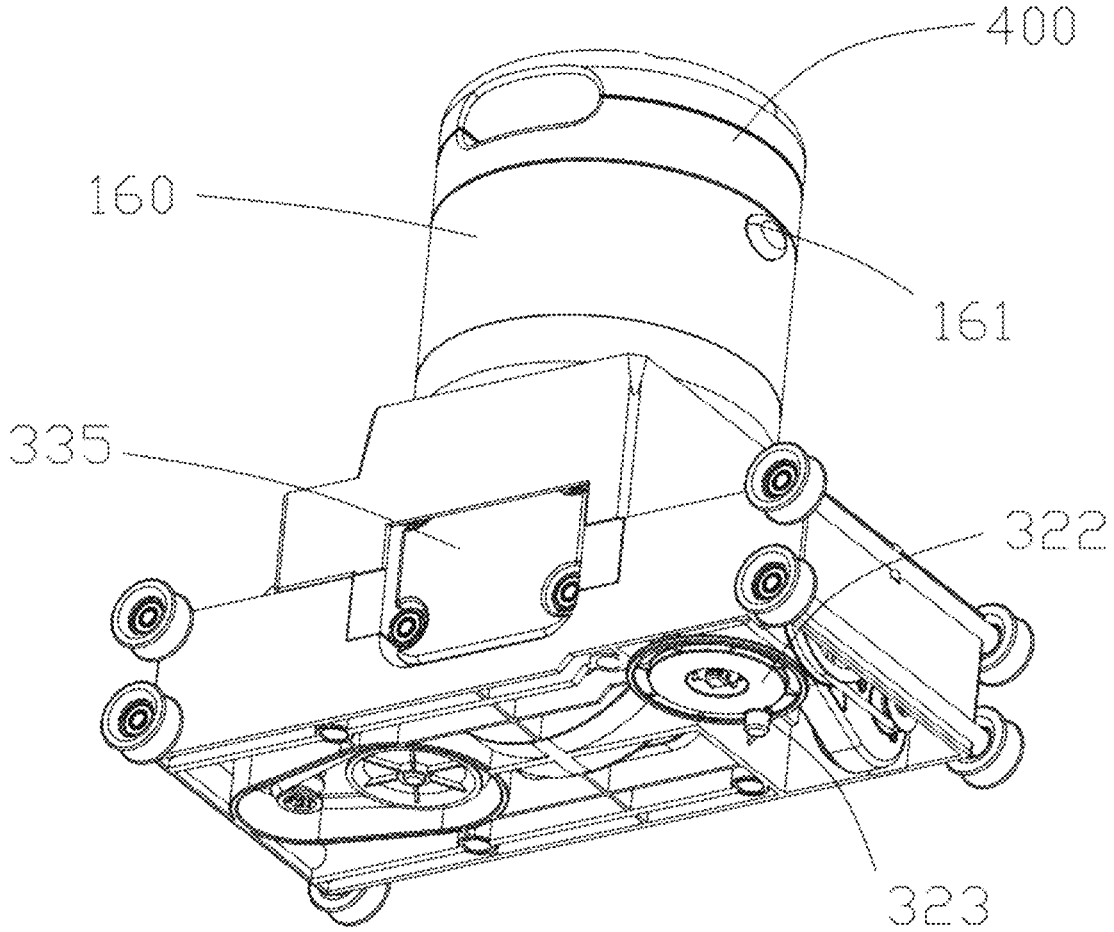
FIG. 8 is a local diagram of a multidimensional rocking chair of the present disclosure.
Figure 9:
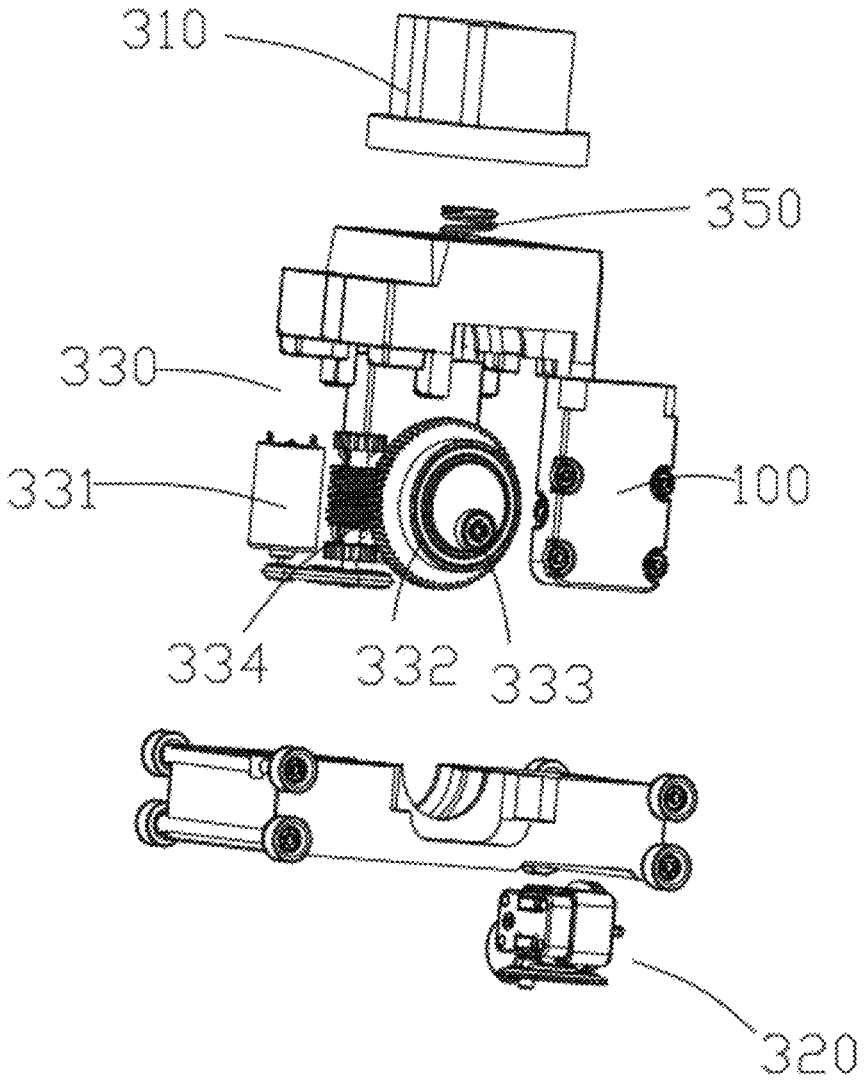
FIG. 9 is an exploded view of a driving machine of a multidimensional rocking chair of the present disclosure.
Figure 10:
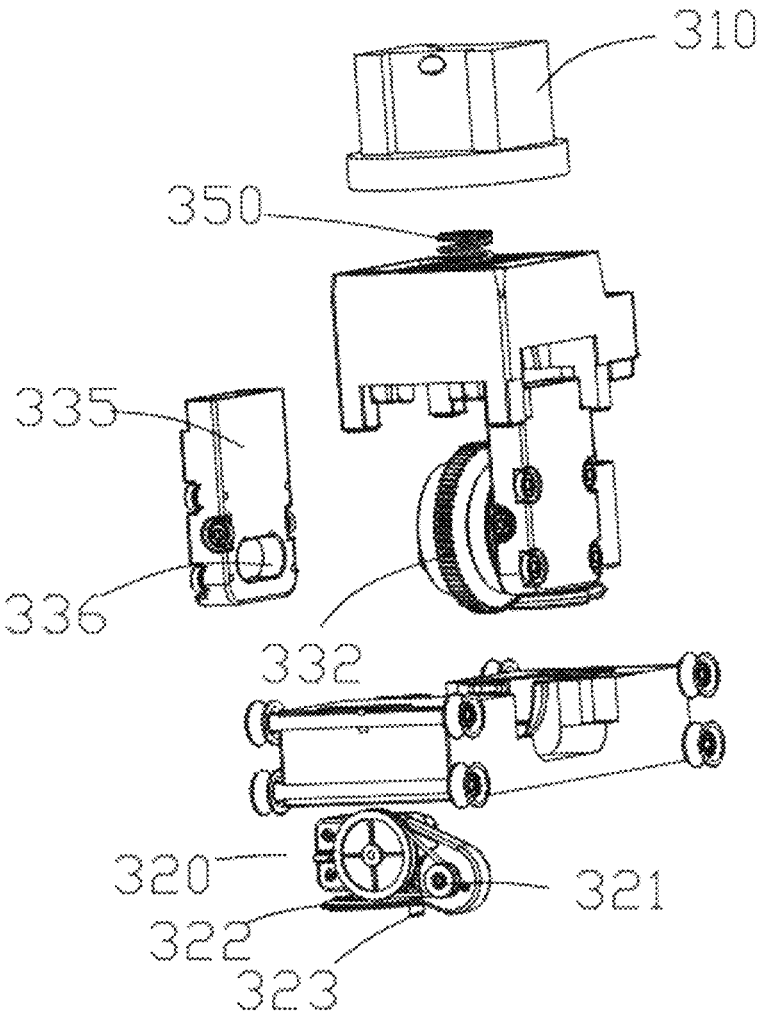
FIG. 10 is a structure diagram of a driving machine of a multidimensional rocking chair of the present disclosure.
Figure 11:
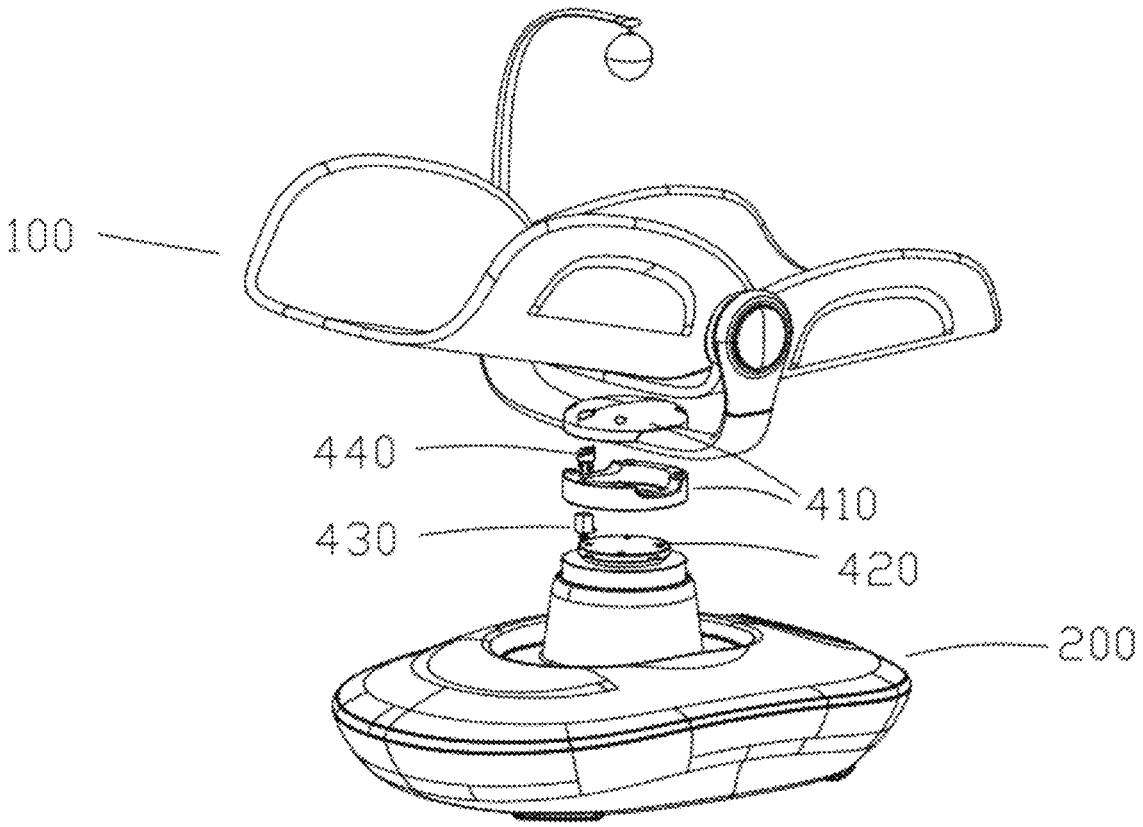
FIG. 11 is a diagram of a rotating base of a multidimensional rocking chair of the present disclosure.
Figure 12:
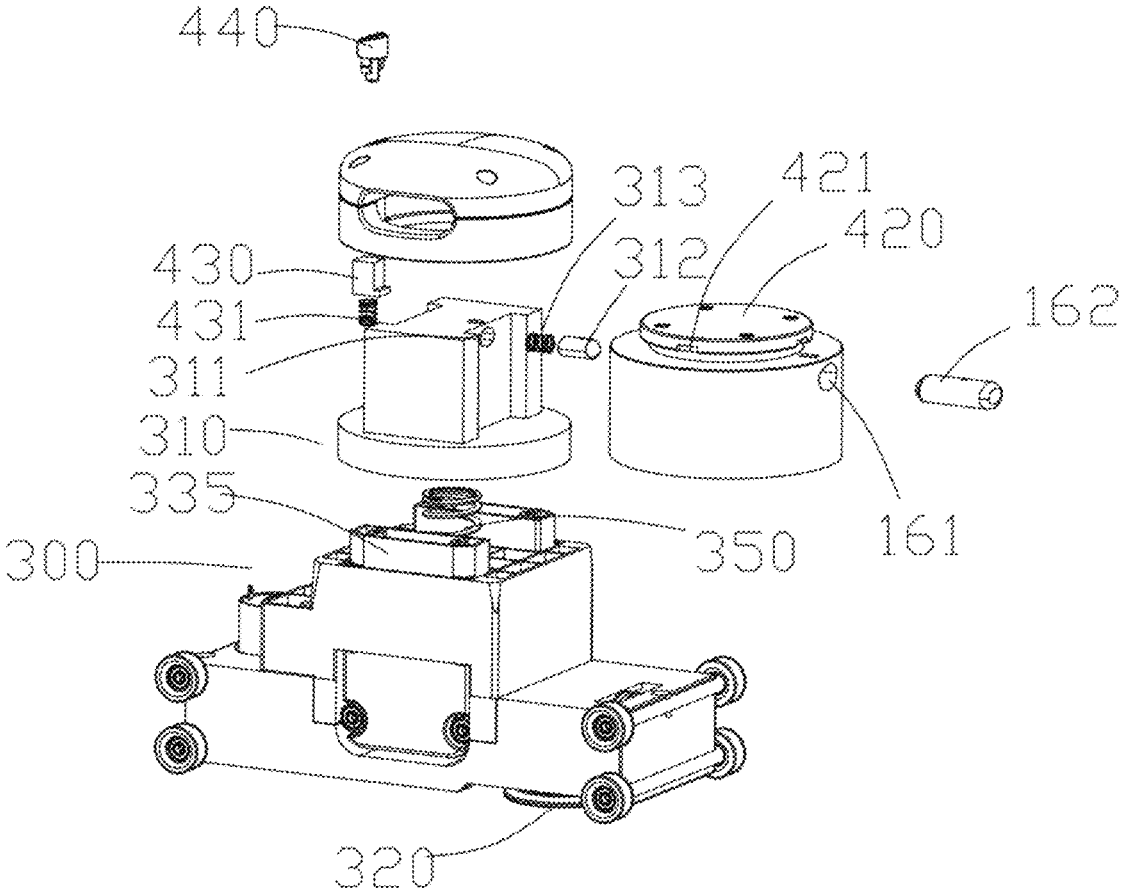
FIG. 12 is an assembly diagram of a rotating base of a multidimensional rocking chair of the present disclosure.

Reference numerals in the drawings are illustrated as below.

100, reclining seat; 110, seat cushion part; 111, locating hole; 112, limit part; 120, backrest part; 121, sliding slot; 122, insert pin; 123, first elastic element; 130, pull rope; 140, gap; 150, bracket; 160, quick-release base; 161, through slot; 162, quick-release button;

200, base; 210, bottom cover; 211, limit sliding slot; 220, upper cover;

300, driving machine; 310, output end; 311, insert slot; 312, quick-release tab; 313, quick-release spring; 314, guide slope; 320, horizontal sliding module; 321, horizontal motor; 322, horizontal cam; 323, horizontal eccentric circular protrusion; 330, vertical lifting module; 331, vertical motor; 332, vertical cam; 333, vertical eccentric circular protrusion; 334, second transmission component; 335, vertical slide block; 336, horizontal slot; 340, horizontal slide rail; 341, upper slide-wheel set; 342, lower slide-wheel set; 350, buffer spring;

400, rotating base; 410, rotating shell; 420, rotary plate; 421, limit groove; 430, switching tab; 431, switching spring; 440, switching button.

DETAILED DESCRIPTION OF THE EMBODIMENTS

The embodiments of the present disclosure are described below in detail, examples of which are shown in the accompanying drawings on which the same or similar designators are used for representing the same or similar elements or elements having the same or similar functions. The following embodiments described in combination with the drawings are exemplary and intended to explain the present disclosure, but they should not be construed as a limitation on the present disclosure.

In the description of the present disclosure, it is to be understood that the orientation or position relations indicated by such terms as "length", "width", "above", "below", "front", "behind", "left", "right", "vertical", "horizontal", "top", "bottom", "inner", "outer", etc. are based on the orientation or position relations shown in the drawings, and are merely for conveniently describing the present disclosure and simplifying the description, rather than indicating or implying that the device or element must have the specific orientation and be constructed and operated according to the specific orientation. Therefore, they should not be construed as a limitation on the present disclosure.

In addition, terms "first", "second" are merely for the purpose of description, but should not be understood as the indication or implication of relative importance or as the implicit indication of the quantity of the designated technical features. Therefore, features defined by "first" and "second" may specifically or implicitly include one or more such features. In the description of the present disclosure, unless otherwise stated, "a plurality of" means two or more than two.

In the description of the present disclosure, unless otherwise specifically stated and defined, terms such as "mounted", "interconnected", "connected", "fixed", etc. should be interpreted expansively. For example, they may be fixed connection, also may be detachable connection, or integration; may be mechanical connection, also may be electrical connection; may be direct connection, also may be indirect connection through an intermediate, and may be internal communication between two elements or interaction between two elements. The ordinary skill in this field can understand the specific implication of the above terms in the present disclosure in accordance with specific conditions.

Referring to FIG. 1, the present embodiment provides a multidimensional rocking chair, including a reclining seat 100 and a base 200. The reclining seat 100 includes a seat cushion part 110 and a backrest part 120. The base 200 has provided therein a driving machine 300. The driving machine 300 has an output end 310 connected to the reclining seat 100 to drive the reclining seat 100 to perform a reciprocating motion.

The driving machine 300 includes a horizontal sliding module 320 and a vertical lifting module 330. The horizontal sliding module 320 is configured to drive the reclining seat 100 to perform horizontal reciprocating sliding relative to the base 200, and the vertical lifting module 330 is configured to drive the reclining seat 100 to perform vertical reciprocating lifting relative to the base 200. By arrangement of two separate horizontal and vertical modules in one same driving machine 300, the reclining seat 100 is capable of performing a compound movement in different degrees of freedom.

In specific implementations, the driving machine 300 can be mounted in an internal cavity of the base 200. The output end 310 of the driving machine 300 is connected to the seat cushion part 110 by means of a bracket 150. The horizontal sliding module 320 can be implemented by adoption of a motor, a cam, a limit sliding slot 211 and other structures. When the motor drives the cam to rotate, the eccentric part of the cam is reciprocating inside the limit sliding slot 211, thereby driving the driving machine 300 and the reclining seat 100 to perform horizontal reciprocating motions. The vertical lifting module 330 can employ a structure of a vertical cam 332 fitting with a slide block. When the motor drives the cam to rotate, the fitting between the cam and the slide block enables the slide block to generate an up-down reciprocating motion, which is then transmitted to the reclining seat 100 by means of the output end 310 to realize a lifting in vertical direction.

During usage, a baby can be placed inside a support space formed by the seat cushion part 110 and the backrest part 120. The driving machine 300 while working can choose to start up the horizontal sliding module 320, the vertical lifting module 330, or both of them, whereby achieving a shaking mode of a single direction or compound directions. Through such structural design, the movement mode of the rocking chair is no longer limited to a single degree of freedom, but the rocking chair can provide a soothing action that combines up and down with horizontal movements close to the embrace of parents.

In one implementation, the seat cushion part 110 and the backrest part 120 are hinged by means of a rotating shaft. With this hinged structure, the backrest part 120 is capable of rotating relative to the seat cushion part 110 around the rotating shaft.

During practical applications, a user can adjust the backrest part 120 to different angles according to the requirements of a baby. For example, when the baby is in a resting or sleeping state, the backrest part 120 can be inclined backward, so that the baby can be in a half-lying or lying down state. When the baby is awake or needs feeding, the backrest part 120 can be adjusted to a relatively upright position, thereby forming a support resembling a sitting posture.

Through the above design, a support relationship of variable angles can be formed between the backrest part 120 and the seat cushion part 110, meeting posture requirements in different usage scenarios.

In a further implementation, a plurality of locating holes 111 are arranged at the hinged connection between the seat cushion part 110 and the backrest part 120 along an arc direction. The backrest part 120 has a side wall formed with a sliding slot 121, the sliding slot 121 has an insert pin 122 slidably mounted therein, and one end of the insert pin 122 can enter inside any one locating hole 111 to achieve positioning of an angle.

In particular, the sliding slot 121 has provided therein a first elastic element 123, for example, a compression spring. The elastic element is connected to the insert pin 122 to apply a continuous force toward the direction of the locating hole 111, so that the insert pin 122 keeps fit into the locating hole 111 under normal circumstances. When the insert pin 122 falls into any one locating hole 111 under the function of the elastic element, the included angle between the backrest part 120 and the seat cushion part 110 is limited at a position corresponding to the locating hole 111, thereby achieving positioning of an angle of the backrest.

During usage, an operator can apply an external force for the insert pin 122 to overcome the acting force of the first elastic element 123 and exit the locating hole 111, and then can rotate the backrest part 120 to a target angle. When the external force is released, the insert pin 12 returns to an original position autonomously under the function of the first elastic element 123 and enters a new locating hole 111, thereby completing adjustment and locking of angle of the backrest part 120.

Through such structural design, multiple angles of adjustment can be formed between the seat cushion part 110 and the backrest part 120, whereby the backrest part 120 can keep a stable positioning under different usage scenarios.

In a further implementation, the hinged connection between the backrest part 120 and the seat cushion part 110 is located at two sides of the backrest part 120, and both of the two sides are provided with the structure of the sliding slot 121 and the insert pin 122. A pull rope 130 is connected between the insert pins 122 at the two sides. A middle part or a tail end of the pull rope 130 is arranged on an exterior surface of the backrest part 120 for the convenience of operation of users.

Under normal usage states, the insert pins 122 at the two sides are embedded into corresponding locating holes 111 respectively under the function of the spring (the first elastic element 123), achieving stable positioning of an angle of the backrest part 120. When it is needed to adjust the angle of the backrest part, an operator can pull the pull rope 130, and the pull force of the pull rope 130 causes the insert pins 122 at the two sides to move along the sliding slots 121 simultaneously to compress the springs and exit the original locating holes 111. At this time, the backrest part 120 can be rotated freely around the rotating shaft.

When the backrest part 120 is rotated to a new angle, the operator releases the pull rope 130, the insert pins 122 return to the original positions under the function of the springs and are embedded again into the locating holes 111 corresponding to the new angle, achieving locking of a new angle.

Through the design of the linkage of the pull rope 130, the actions of the insert pins 122 at the two sides can be controlled simultaneously, which makes the adjustment of angle easier and faster, reduces the cumbersome steps of operating the insert pins 122 at the two sides one by one, and guarantees the synchronization and safety of adjustment of the backrest.

In a further implementation, a gap 140 is provided between the backrest part 120 and the seat cushion part 110, and the pull rope 130 can pass through the gap 140. An operating end of the pull rope 130 can extend to a rear side or a lower position of the backrest part 120, for an operator to directly conduct the pull operation from the rear side of the backrest part 120.

During practical usage, when it is needed to adjust the angle of the backrest, an operator can pull the pull rope 130 from the rear side of the backrest, then the pull rope 130 is sliding freely in the gap 140 and causes the insert pins 122 at the two sides to move simultaneously, the insert pins 122 can overcome the springs' forces and exit the locating holes 111, and at this time the backrest part 120 can be rotated around the rotating shaft for angle adjustment. When the pull rope 130 is released, the insert pins 122 return to original positions under the function of the springs and enter new locating holes 111 again, achieving locking of a new angle.

Through the arrangement of the pull rope 130 in the gap 140 between the backrest part 120 and the seat cushion part 110, the pull rope 130 does not affect the activity space of the baby on the reclining seat 100, but can provide a convenient operating position for the operator, improving the easiness of adjustment of angle.

In the present embodiment, the multidimensional rocking chair further includes a bracket 150 configured to bear and support. The bracket 150 is connected between the seat cushion part 110 and the output end 310 of the driving machine 300 and is configured to effectively transmit the movement output of the driving machine 300 to the seat cushion part 110. The seat cushion part 110 has an outer side provided with a limit part 112, and the limit part 112 forms a snap-fit with the bracket 150, whereby fast locating and fixation can be realized through the snap-fit during the installation process. Through the snap-fit structure, the seat cushion part 110 can be securely held on the bracket 150 when doing long-term reciprocating motions or subjected to external forces, avoiding risks of loosening, displacement, even disengagement.

Further, the seat cushion part 110 is arranged inclined toward the backrest part 120 relative to the horizontal plane after being snap-fitted with the bracket 150. Such inclined arrangement enables a baby or user to be in a natural slight lying-back state on the seat cushion part 110, which is compliant with ergonomic support characteristics, can effectively disperse body weight while guaranteeing comfort, and reduces local pressure. In addition, the inclined structure of the seat cushion part 110 can also prevent the baby slipping forward due to inertia and enhance the overall protectiveness and safety.

From this, it can be seen that the collaborative design of the bracket 150, the limit part 112 and the inclined arrangement not only ensures the stability of the connection between the seat cushion part 110 and the driving machine 300, but also improves the comfort and safety of the baby during usage, further enhancing the practicality and reliability of the device.

In another further implementation, the multidimensional rocking chair further includes a quick-release base 160. The quick-release base 160 is arranged between the reclining seat 100 and the output end 310 of the driving machine 300.

The reclining seat 100 is detachably connected to the output end 310 of the driving machine 300 by means of the quick-release base 160.

In particular, the quick-release base 160 can be sleeved around the output end 310 of the driving machine 300, and a lower structure of the reclining seat 100 is connected to the quick-release base 160. When installation is needed, an operator sleeves the quick-release base 160 on the output end 310 of the driving machine 300, making it in fixed fit with the driving machine 300, thereby causing the reclining seat 100 to move synchronously with the driving machine 300. When detachment is needed, the operator can separate the quick-release base 160 from the output end 310 by means of a preset unlocking structure, achieving fast detachment of the reclining seat 100.

Through the arrangement of the quick-release base 160 between the reclining seat 100 and the driving machine 300, not only is a reliable connection formed therebetween, but a fast assembly and disassembly capability is also equipped. Such structure not only facilitates daily cleaning and maintenance, but also eases separation of the reclining seat from the base 200 during transport or storage, enhancing the practicality of the product.

In a preferred implementation, the output end 310 of the driving machine 300 is formed with an insert slot 311, and the insert slot 311 has provided therein a quick-release spring 313 and a quick-release tab 312. The quick-release base 160 can be sleeved around the output end 310, the quick-release base 160 is formed with a through slot 161 on a wall body thereof, and the through slot 161 corresponds to the insert slot 311 in position.

In particular, when the quick-release base 160 is sleeved on the output end 310 of the driving machine 300, under the function of the quick-release spring 313, the quick-release tab 312 extends autonomously into the through slot 161 of the quick-release base 160, making the quick-release base 160 form a firm locking with the output end 310, thus guaranteeing the reliability of the reclining seat 100 during operation.

Further, the through slot 161 of the quick-release base 160 has provided therein a quick-release button 162. The quick-release button 162 abuts against the quick-release tab 312. When an operator presses the quick-release button 162, the quick-release button 162 pushes the quick-release tab 312 to move inward and overcome the elastic force of the quick-release spring 313, whereby the quick-release tab 312 exits the through slot 161. At this time, the locking between the quick-release base 160 and the output end 310 is released, and the operator can easily detach the quick-release base 160.

Through the design of this quick-release structure, an effect of autonomous locking plus manual unlocking is achieved, which not only guarantees the safety and stability of the reclining seat 100 in a working state, but also greatly improves the convenience of installation and detachment, particularly being suitable for usage scenarios needing frequent transport, storage or cleaning.

In another preferred implementation, the quick-release tab 312 has an end head provided with a guide slope 314, and the guide slope 314 is arranged inclined toward the direction of compressing the quick-release spring 313.

In particular, when an operator sleeves the quick-release base 160 on the output end 310 of the driving machine 300 from the top down, a bottom end of the quick-release base 160 first abuts against the guide slope 314 of the quick-release tab 312. During this process, the quick-release tab 312 is forced to move inward under the function of the guide slope 314, and then compresses the quick-release spring 313 and temporarily returns back into the insert slot 311. As the quick-release base 160 continues to press down until the through slot 161 of the quick-release base 160 is aligned to the insert slot 311 of the output end 310, the quick-release spring 313 releases the elastic force and pushes the quick-release tab 312 to autonomously extend into the through slot 161, achieving a reliable locking of the quick-release base 160 with the output end 310.

Such structure achieves the autonomous retraction and return of the quick-release tab 312 by means of the guide slope 314, allowing the quick-release base 160 to accomplish locating and locking without extra operations during installation. Compared to conventional manual alignment or manual unlocking, the solution of the present disclosure greatly improves the assembly efficiency and guarantees the smoothness and safety of the installation process.

In a preferred implementation, the base 200 includes a bottom cover 210 and an upper cover 220. The bottom cover 210 and the upper cover 220 have a cavity enclosed therebetween, which is configured to contain the driving machine 300 and matched mechanisms.

Inside the cavity, a horizontal slide rail 340 is arranged extending a length direction of the base 200. The driving machine 300 is slidably mounted on the horizontal slide rail 340, being capable of performing a reciprocating sliding motion along the horizontal direction.

In order to achieve the above driving effect, the bottom cover 210 has a bottom end formed with a limit sliding slot 211. The extending direction of the limit sliding slot 211 is not parallel to the horizontal slide rail 340. The horizontal sliding module 320 includes a horizontal motor 321 and a horizontal cam 322 connected thereto. The horizontal cam 322 is horizontally placed, and the horizontal cam 322 has a surface provided with a horizontal eccentric circular protrusion 323. The eccentric circular protrusion extends to and abuts against an inside of the limit sliding slot 211.

During a specific working process, the horizontal motor 321 drives the horizontal cam 322 to rotate by means of a first transmission component. With the rotation of the cam, the eccentric circular protrusion located inside the limit sliding slot 211 generates a relative sliding under the restriction of the slot wall. Since the direction of the limit sliding slot 211 is not parallel to the direction of the slide rail, the rotation of the eccentric circular protrusion is converted into a thrust along the slide rail, thereby driving the driving machine 300 to perform reciprocating sliding on the horizontal slide rail 340.

With the above structural design, by utilizing the mating relationship between the eccentric circular protrusion and the limit sliding slot 211, the rotation motion is converted into a linear reciprocating motion, whereby the driving machine 300 can drive the reclining seat 100 to perform a regular horizontal swing. Such solution not only enables a compact transmission structure, but also can perform stable reciprocating driving within a limited space, being conducive to the minimization and integration of the entire device.

In a further implementation, the driving machine 300 is provided with an upper slide-wheel set 341 and a lower slide-wheel set 342, which are located at upper and lower sides of the horizontal slide rail 340 respectively.

In particular, both the upper slide-wheel set 341 and the lower slide-wheel set 342 are connected to a shell of the driving machine 300. The wheel bodies are in contact with a guide surface of the horizontal slide rail 340. Through the symmetric arrangement of the upper and lower sets of slide-wheels, the running state of the driving machine 300 can be effectively limited and guided during the process of the driving machine 300 reciprocally sliding along the slide rail, avoiding occurrences of swinging or getting stuck due to one-side stress.

During practical working, when the eccentric circular protrusion of the horizontal cam 322 is reciprocally moving inside the limit sliding slot 211 and driving the driving machine 300 to move along the slide rail, the upper and lower slide-wheel sets keep fit with the slide rail at the same time, allowing the driving machine 300 to keep a stable motion on the slide rail. By employing the rolling friction of the slide-wheel instead of the sliding friction of a slide block, not only is the driving resistance reduced, but the abrasion and noise during the running process are reduced, enhancing the smoothness and durability of the overall movement.

Therefore, by arrangement of the upper slide-wheel set 341 and the lower slide-wheel set 342 on both sides of the driving machine 300, not only is the sliding smoothness of the driving machine 300 guaranteed, but the service life of the device is prolonged, further enhancing the comfort and safety of movement of the baby rocking chair.

In a further implementation, the vertical lifting module 330 includes a vertical cam 332 and a vertical slide block 335.

In particular, the vertical cam 332 is driven by a vertical motor 331. The vertical cam 332 is arranged vertically inside the driving machine 300, and has a surface provided with a vertical eccentric circular protrusion 333. The vertical slide block 335 is slidably mounted in a vertical guide cavity inside the driving machine 300, being capable of generating vertical reciprocating sliding relative to the driving machine 300. The vertical slide block 335 has a surface formed with a horizontal slot 336, and the vertical eccentric circular protrusion 333 is slidably fit into the horizontal slot 336.

When the device is operating, when the vertical motor 331 drives the vertical cam 332 to rotate by means of a second transmission component 334, the vertical eccentric circular protrusion 333 generates a sliding motion inside the horizontal slot 336 and slides reciprocally within the length range of the horizontal slot 336 following the rotation of the cam, whereby forcing the vertical slide block 335 to perform a vertical reciprocating motion. Since the vertical slide block 335 is connected to the output end 310 of the driving machine 300, the driving machine 300 can finally transmit the vertical motion to the reclining seat 100, achieving a vertical lifting effect of the baby seat.

Through the above structure, by utilizing the cam-sliding slot 121 transmission principle, the rotation motion of the motor can be converted into the reciprocating linear motion of the vertical slide block 335, enabling a compact structure and a smooth movement process. Compared to conventional link type lifting structures, this solution avoids the problem of accumulation of gaps caused by multiple rods and improves the accuracy and stability of movement. Meanwhile, since the shape of the vertical cam 332 and the circular protrusion can be designed according to needs, the magnitude and frequency of the vertical movement can be adjusted flexibly in order to meet the comforting requirements of different babies.

Through the structural design of the above driving machine 300, the reclining seat 100 can swing in horizontal direction and lift in vertical direction at the same time, allowing the rocking chair to have a multidimensional movement mode. The experience of the baby on the reclining seat 100 is closer to the rhythm in human embrace, which can facilitate soothing emotions and promoting sleep. Meanwhile, the combination of the cam and the guide structure reduces the problem of accumulation of gaps 140 of conventional multi-link structures, making the overall movement more accurate and stable.

In the present embodiment, the connection manner between the output end 310 of the driving machine 300 and the vertical slide block 335 can be designed differently according to practical application requirements. Specifically, the output end 310 and the vertical slide block 335 can adopt any one of the following three structures.

In one mode, the output end 310 and the vertical slide block 335 can be arranged as an integrated structure, that is, they two are manufactured into one piece through overall processing or molding processes, thereby reducing the steps of assembly and enhancing the stability of structure, which is suitable for scenarios having high demand on overall strength and reliability.

In another mode, the output end 310 and the vertical slide block 335 can be interconnected through connection pieces, for example, they are fixed by bolts, insert pin 122, snap-fit or other mechanical connection structures. In this condition, the connection between the output end 310 and the vertical slide block 335 not only can guarantee the reliability of transmission, but also can facilitate subsequent maintenance or parts replacement.

In still another mode, the output end 310 and the vertical slide block 335 can adopt an abutting mode to achieve movement transmission, that is, the output end 310 can directly abut against a stress surface of the vertical slide block 335. When the vertical slide block 335 is generating a reciprocating motion in vertical direction, its displacement can be transmitted to the reclining seat 100 by means of the abutting function, thereby driving the reclining seat 100 to perform a corresponding lifting motion. Such structure is relatively simple, with a low manufacturing cost, which is suitable for the application scenarios having high demand on assembly convenience.

Through the above different implementations, the connection relationship between the output end 310 of the driving machine 300 and the vertical slide block 335 can be flexibly adjusted, guaranteeing the reliability and diversity of movement transmission, and providing multiple feasible solutions for the implementation of the product in different design requirements.

In the present embodiment, a buffer spring 350 is provided below the output end 310 of the driving machine 300. The buffer spring 350 is located between the output end 310 and the base 200 or a related support part, which is configured to provide a buffer function during the process of the driving machine 300 driving the reclining seat 100 to perform a vertical lifting motion.

When the vertical lifting module 330 drives the vertical slide block 335 to cause the reclining seat 100 to move downward, the output end 310 will compress the buffer spring 350 gradually, so that the buffer spring 350 stores an elastic potential energy to effectively reduce an impact force caused by inertia, preventing the reclining seat 100 against excessive vibration or impact at the end of the vertical motion, and enhancing the safety and comfort of baby sitting on it.

Meanwhile, when the output end 310 of the driving machine 300 drives the reclining seat 100 upward to return back, the buffer spring 350 will release its elastic potential energy to provide an auxiliary thrust for the vertical lifting motion, which not only can reduce the load of the driving machine, but also can make the process of vertical motion more stable and smoother.

The arrangement of the buffer spring 350 below the output end 310 of the driving machine 300 can effectively improve the smoothness of the vertical lifting motion, reduce mechanical impact, enhance the durability of the entire device, and further improve the comfortable experience of baby in it.

In one optional embodiment, the multidimensional rocking chair further includes a rotating base 400. The rotating base 400 is arranged between the base 200 and the reclining seat 100 and is configured to adjust a horizontal angle between the base 200 and the reclining seat 100.

The rotating base 400 preferably is a ring-shaped structure. A lower end thereof is rotatably connected to the base 200, and an upper end thereof is fixedly connected to the reclining seat 100. With such structure, the reclining seat 100 can be rotated relative to the base 200 around a vertical central axis. To achieve angle fixation, the rotating base 400 can be provided with a limit part 112, for example, a positioning ring gear or a plurality of positioning holes 111. The base 200 is provided with a snap-fit element, an insert pin 122 or a locking member at a corresponding position. When a user needs to adjust the horizontal angle of the reclining seat 100, he/she first unlocks the locking member, pushes the reclining seat 100 to rotate the rotating base 400 to a target angle position, and then reinserts or snaps the locking member into the limit part 112, thereby to securely fix the angle.

Such implementation enables the reclining seat 100 to be flexibly adjusted according to different application scenarios, for example, changing the orientation for parents to take care of the baby, avoiding direct sunlight or matching with indoor spatial layout. Due to the rotation fit relationship between the rotating base 400 and the base 200, the convenience of adjustment operation is ensured without affecting the horizontal sliding and vertical lifting functions of the driving machine 300, thereby further enhancing the multidimensional adjustment capability and user experience of the whole machine.

In a further embodiment, the rotating base 400 includes a rotary plate 420 and a rotating shell 410.

In particular, the rotary plate 420 is fixedly connected to the output end 310 of the driving machine 300, which is configured to transmit the power of the driving machine 300 to the upper structure. The rotating shell 410 is formed with a circular groove; the rotary plate 420 is mounted inside the circular groove and forms a rotation fit relationship with an inner wall of the circular groove, whereby the rotary plate 420 and the rotating shell 410 can have a relative rotation therebetween.

With such structure, the rotating shell 410 is fixedly connected to the reclining seat 100. The rotation adjustment of the reclining seat 100 is achieved by means of the relative rotation between the rotating shell 410 and the rotary plate 420. In particular, when it is needed to change the horizontal angle between the reclining seat 100 and the base 200, a user can rotate the rotating shell 410 relative to the rotary plate 420 by means of an external force, thereby causing an adjustment of horizontal angle of the reclining seat 100. After the adjustment is completed, the rotating shell 410 and the rotary plate 420 can be fixed at the relative position by means of a locking member or a friction limit structure.

Such implementation provides a rotating base 400 between the output end 310 of the driving machine 300 and the reclining seat 100, allowing the reclining seat 100 to be flexibly adjusted in horizontal angle, which not only improves the adaptability of the baby rocking chair in different usage scenarios, but also does not interfere with the horizontal sliding and vertical lifting functions achieved by the driving machine 300.

In a preferred embodiment, the rotary plate 420 has a surface formed with a plurality of limit grooves 421 distributed along the circumferential direction, which are configured to provide locking references for multiple angles of positions.

The rotating shell 410 has an inner wall provided with a switching tab 430 and a switching spring 431. The switching spring 431 has one end fixedly connected to the shell, and another end acting on the switching tab 430, thereby driving the switching tab 430 to extend out always toward the surface of the rotary plate 420. When the rotary plate 420 and the rotating shell 410 are at certain relative position, the switching tab 430 falls into the limit groove 421 autonomously under the function of the spring, thereby limiting the relative rotation between the rotary plate 420 and the rotating shell 410 and thus fixing the reclining seat 100 at a corresponding position of a horizontal angle.

In order to realize angle adjustment, the rotating shell 410 has slidably mounted therein a switching button 440. The switching button 440 forms a transmission fit with the switching tab 430. When a user presses the switching button 440, the switching button 440 causes the switching tab 430 to move away from the limit groove 421, whereby the switching tab 430 overcomes the spring's force to disengage from the limit groove 421 and then free the locking on the rotary plate 420. At this time, a user can rotate the reclining seat 100 for angle adjustment. After the angle adjustment is completed, the user releases the switching button 440, and the switching tab 430 enters inside another adjacent limit groove 421 under the function of the elastic force of the switching spring 431, achieving the locking of a new angle.

Such design achieves rapid positioning and stable fixation of the reclining seat 100 at multiple horizontal angles by utilizing the fit between the switching tab 430 and the limit groove 421. It is easy to operate, structurally reliable, and can avoid unsafe situations caused by accidental rotation of the rocking chair during usage.

The present disclosure provides a multidimensional rocking chair, which integrates angle adjustment, quick-release structures and multidimensional driving and rotation adjustment modules on the basis of conventional baby rocking chairs, achieving a comprehensive solution that is structurally reasonable, safe, reliable, and easy to operate.

In particular, the backrest angle adjustment mechanism achieves a multi-position adjustment for the included angle between the backrest part 120 and the reclining seat 100 by utilizing the cooperation of the insert pin 122, the sliding slot 121 and the elastic element, which can suit different baby postures and usage scenarios and enhance comfort and safety. The quick release structure can enable a quick detachment between the reclining seat 100 and the driving machine 300 by the arrangement of the quick-release tab 312, the guide slope 314 and the button, which is convenient for transportation and storage, as well as daily cleaning and maintenance. The multidimensional driving module combines the compound movements of horizontal sliding and vertical lifting, achieves multi-position adjustment of horizontal angle through the rotating base 400 fitting with the switching locking mechanism, enabling the rocking chair to provide multi-dimensional and multi-mode rocking modes, effectively soothing babies and simulating manual shaking effects.

Through the above design, the present disclosure has achieved significant improvements in structural and functional integration, operational convenience, and usage safety compared to existing technologies.

Finally, it should be noted that: the above are preferred embodiments of the present disclosure merely and are not intended to limit the present disclosure. Although the present disclosure has been described in detail by reference to the above mentioned embodiments, for those skilled in the art, modifications also can be made to the technical scheme recorded in each embodiment mentioned above, or partial technical features can be substituted equivalently. Any modifications, equivalent substitutes and improvements, etc., made within the spirit and principle of the present disclosure all are included in the protection scope of the present disclosure.

What is claimed is:

1. A multidimensional rocking chair, comprising:

a reclining seat comprising a seat cushion part and a backrest part; and a base having provided therein a driving machine, the driving machine having an output end connected to the reclining seat to drive movement of the reclining seat, wherein the driving machine comprises a horizontal sliding module and a vertical lifting module, the horizontal sliding module being configured to drive the reclining seat to move horizontally, and the vertical lifting module being configured to drive the reclining seat to move vertically;

wherein the seat cushion part and the backrest part have a hinged connection therebetween, and wherein an included angle between the backrest part and the seat cushion part is adjustable, wherein a plurality of locating holes are arranged at the hinged connection between the seat cushion part and the backrest part;

wherein the backrest part is formed with a sliding slot, the sliding slot having an insert pin slidably mounted therein, and when the insert pin falls into any one locating hole, the included angle between the backrest part and the seat cushion part being limited at a corresponding position; and wherein the sliding slot has provided therein a first elastic element, the first elastic element being configured to apply onto the insert pin an elastic force toward the direction of the locating hole.

2. The multidimensional rocking chair according to claim 1, wherein the hinged connection between the backrest part and the seat cushion part is located at two sides of the backrest part, a pull rope being provided and connected between the insert pins at the two sides; and wherein when the pull rope is pulled, the pull rope causes the insert pin to squeeze against the spring and disengage from the locating hole.

3. The multidimensional rocking chair according to claim 2, wherein a gap is provided between the backrest part and the seat cushion part, and wherein the pull rope can pass through the gap.

4. The multidimensional rocking chair according to claim 1, further comprising a bracket, wherein the bracket is configured to connect the seat cushion part and the output end of the driving machine, and wherein the seat cushion part has an outer side provided with a limit part, the seat cushion part being snap-fitted with the bracket by means of the limit part, and the seat cushion part being inclined toward the backrest part.

5. The multidimensional rocking chair according to claim 1, further comprising a quick-release base, wherein the reclining seat is detachably connected to the output end of the driving machine by means of the quick-release base.

6. A multidimensional rocking chair, comprising:

a reclining seat comprising a seat cushion part and a backrest part; and a base having provided therein a driving machine, the driving machine having an output end connected to the reclining seat to drive movement of the reclining seat, wherein the driving machine comprises a horizontal sliding module and a vertical lifting module, the horizontal sliding module being configured to drive the reclining seat to move horizontally, and the vertical lifting module being configured to drive the reclining seat to move vertically;

a quick-release base, wherein the reclining seat is detachably connected to the output end of the driving machine by means of the quick-release base; and wherein the output end of the driving machine is formed with an insert slot, the insert slot having provided therein a quick-release spring and a quick-release tab;

wherein the quick-release base can be sleeved around the output end, the quick-release base being formed with a through slot, and the through slot corresponding to the insert slot in position;

wherein the quick-release tab extends into the through slot under the function of the spring, thereby to fix the quick-release base with the output end; and wherein the through slot has provided therein a quick-release button, and wherein when the quick-release button is pressed to squeeze against the quick-release tab so that the quick-release tab exits the through slot, the quick-release base can be detached.

7. The multidimensional rocking chair according to claim 6, wherein the quick-release tab has an end head provided with a guide slope, the guide slope being inclined toward the direction of compressing the quick-release spring;

wherein when the quick-release base is being sleeved from top down, a bottom end of the quick-release base abuts against the guide slope, whereby the quick-release tab squeezes against the quick-release spring and returns back; and wherein when the through slot is aligned to the insert slot, the quick-release tab inside the insert slot enters inside the through slot under the driving of the quick-release spring, thereby to fix the quick-release base with the output end.

8. The multidimensional rocking chair according to claim 6, wherein the base comprises a bottom cover and an upper cover, the bottom cover and the upper cover having a cavity provided therebetween;

wherein the cavity has provided therein a horizontal slide rail, the driving machine being capable of sliding along the horizontal slide rail by slidable mounting on the horizontal slide rail;

wherein the bottom cover has a bottom end formed with a limit sliding slot, the limit sliding slot being not parallel to the horizontal slide rail;

wherein the horizontal sliding module comprises a horizontal motor and a horizontal cam, the horizontal cam being horizontally placed, the horizontal cam having a surface provided with a horizontal eccentric circular protrusion, and the eccentric circular protrusion being located inside the limit sliding slot; and wherein when the horizontal motor drives the horizontal cam to rotate by means of a first transmission component, the horizontal eccentric circular protrusion is reciprocally sliding inside the limit sliding slot, whereby enabling the driving machine to reciprocally slide along the horizontal slide rail.

9. The multidimensional rocking chair according to claim 8, wherein the driving machine is provided with an upper slide-wheel set and a lower slide-wheel set, the upper slide-wheel set and the lower slide-wheel set being located at upper and lower sides of the horizontal slide rail respectively.

10. The multidimensional rocking chair according to claim 8, wherein the vertical lifting module comprises:

a vertical cam driven by a vertical motor, the vertical cam being arranged vertically and having a surface provided with a vertical circular protrusion; and a vertical slide block slidably mounted inside the driving machine, the vertical slide block being capable of sliding vertically relative to the driving machine, the vertical slide block having a surface formed with a horizontal slot, and the vertical circular protrusion being slidably fit into the horizontal slot; and wherein when the vertical motor drives the vertical cam to rotate by means of a second transmission component, the vertical circular protrusion is reciprocally sliding inside the horizontal slot, whereby enabling the vertical slide block to perform a vertical reciprocating motion.

11. The multidimensional rocking chair according to claim 10, wherein the output end of the driving machine is integrated with or connected to or abuts against the vertical slide block.

12. The multidimensional rocking chair according to claim 11, wherein a buffer spring is provided below the output end of the driving machine.

13. A multidimensional rocking chair, comprising:

a reclining seat comprising a seat cushion part and a backrest part; and a base having provided therein a driving machine, the driving machine having an output end connected to the reclining seat to drive movement of the reclining seat, wherein the driving machine comprises a horizontal sliding module and a vertical lifting module, the horizontal sliding module being configured to drive the reclining seat to move horizontally, and the vertical lifting module being configured to drive the reclining seat to move vertically;

a rotating base, wherein the rotating base is located between the base and the reclining seat, and wherein the rotating base is configured to adjust a horizontal angle between the base and the reclining seat.

14. The multidimensional rocking chair according to claim 13, wherein the rotating base comprises:

a rotary plate connected to the output end of the driving machine; and a rotating shell formed with a circular groove, the rotary plate being located inside the circular groove, wherein the rotating shell and the rotary plate can have a relative rotation therebetween; and wherein the rotating shell is fixedly connected to the reclining seat, and wherein the reclining seat is configured to adjust the horizontal angle between the reclining seat and the base by means of the fit between the rotating shell and the rotary plate.

15. The multidimensional rocking chair according to claim 13, wherein the rotary plate has a surface formed with a plurality of limit grooves;

wherein the rotating shell has provided therein a switching tab and a switching spring, the switching spring being configured to drive the switching tab to fall into the limit groove of the rotary plate, whereby to limit the relative rotation between the rotary plate and the rotating shell; and wherein the rotating shell has slidably mounted therein a switching button, the switching button being capable of pushing the switching tab to overcome the spring's force and disengage from the limit groove.

16. The multidimensional rocking chair according to claim 13, further comprising a quick-release base, wherein the reclining seat is detachably connected to the output end of the driving machine by means of the quick-release base.

17. The multidimensional rocking chair according to claim 13, wherein the base comprises a bottom cover and an upper cover, the bottom cover and the upper cover having a cavity provided therebetween;

wherein the cavity has provided therein a horizontal slide rail, the driving machine being capable of sliding along the horizontal slide rail by slidable mounting on the horizontal slide rail;

wherein the bottom cover has a bottom end formed with a limit sliding slot, the limit sliding slot being not parallel to the horizontal slide rail;

wherein the horizontal sliding module comprises a horizontal motor and a horizontal cam, the horizontal cam being horizontally placed, the horizontal cam having a surface provided with a horizontal eccentric circular protrusion, and the eccentric circular protrusion being located inside the limit sliding slot; and wherein when the horizontal motor drives the horizontal cam to rotate by means of a first transmission component, the horizontal eccentric circular protrusion is reciprocally sliding inside the limit sliding slot, whereby enabling the driving machine to reciprocally slide along the horizontal slide rail.

* * * * *